US006056602A

United States Patent [19]

Wu

[11] Patent Number: 6,056,602

[45] Date of Patent: May 2, 2000

[54] ELECTRICAL JACK

[75] Inventor: Kun-Tsan Wu, Tu-chen, Taiwan

[73] Assignee: Hon Hai Precision Ind. Co., Ltd., Taipei Hsien, Taiwan

[21] Appl. No.: 09/337,971

[22] Filed: Jun. 22, 1999

[30] Foreign Application Priority Data

Jun. 25, 1998 [TW] Taiwan ..... 87210202

[51] Int. Cl.[7] ..... H01R 24/04

[52] U.S. Cl. ..... 439/668

[58] Field of Search ..... 439/668, 669, 439/188, 108

[56] References Cited

U.S. PATENT DOCUMENTS 5,338,215 8/1994 Lee et al. .

5,893,767 4/1999 Broschard, III ..... 439/668

5,919,052 7/1999 Ho ..... 439/668

6,000,970 12/1999 Wu ..... 439/668

*Primary Examiner*—Paula Bradley

*Assistant Examiner*—Tho D. Ta

*Attorney, Agent, or Firm*—Wei Te Chung

[57] ABSTRACT

An electrical jack comprises a rectangular insulative body, an insulative bottom member, a grounding terminal, two signal terminals, and two detecting terminals. The signal terminals and the detecting terminals are received in passageways defined in the body. The signal terminals each have a fixing portion a spring portion, an engaging portion and a solder portion proximate the engaging portion. The spring portion is deflected by a pin of an inserted connector to engage with the engaging portion thereby providing a short electrical path therethrough.

10 Claims, 5 Drawing Sheets

ELECTRICAL JACK

BACKGROUND OF THE INVENTION

The present invention generally relates to an electrical jack, and particularly to an electrical jack having terminals which have a short electrical path thereby promoting effective signal transmission therethrough.

Audio jacks are commonly mounted on a circuit board to transmit audio signals. An electrical current conducted through such a device is small so that terminals used therein must have a low electrical resistance. Thus, the electrical voltage consumed by the terminals will be insignificant thereby ensuring proper signal transmission. To achieve such a goal, the terminals are manufactured from a metal of low conductance and have a limited size. However, small terminals are not mechanically reliable and do not provide sufficient resiliency during assembly. Furthermore, metal of low conductance is usually expensive thereby increasing the overall cost of the audio jack. A related prior art is disclosed in U.S. Pat. No. 5,092,795.

SUMMARY OF THE INVENTION

Accordingly, the purpose of the present invention is to provide an electrical jack having terminals with a short signal transmission electrical path.

To fulfill the above-mentioned purpose, an electrical jack comprises a rectangular insulative body, an insulative bottom member, a grounding terminal, two signal terminals, and two detecting terminals. The signal terminals and the detecting terminals are received in passageways defined in the body. The signal terminals each have a fixing portion, a spring portion, an engaging portion and a solder portion proximate the engaging portion. The spring portion of the signal terminal is deflected by a pin of an inserted connector to engage with the engaging portion thereof thereby providing an electrical path therethrough. Such an electrical path has a limited length thereby promoting excellent conductivity for signal transmission.

DETAILED DESCRIPTION OF THE PREFERRED EMBODIMENT

Figure 1:
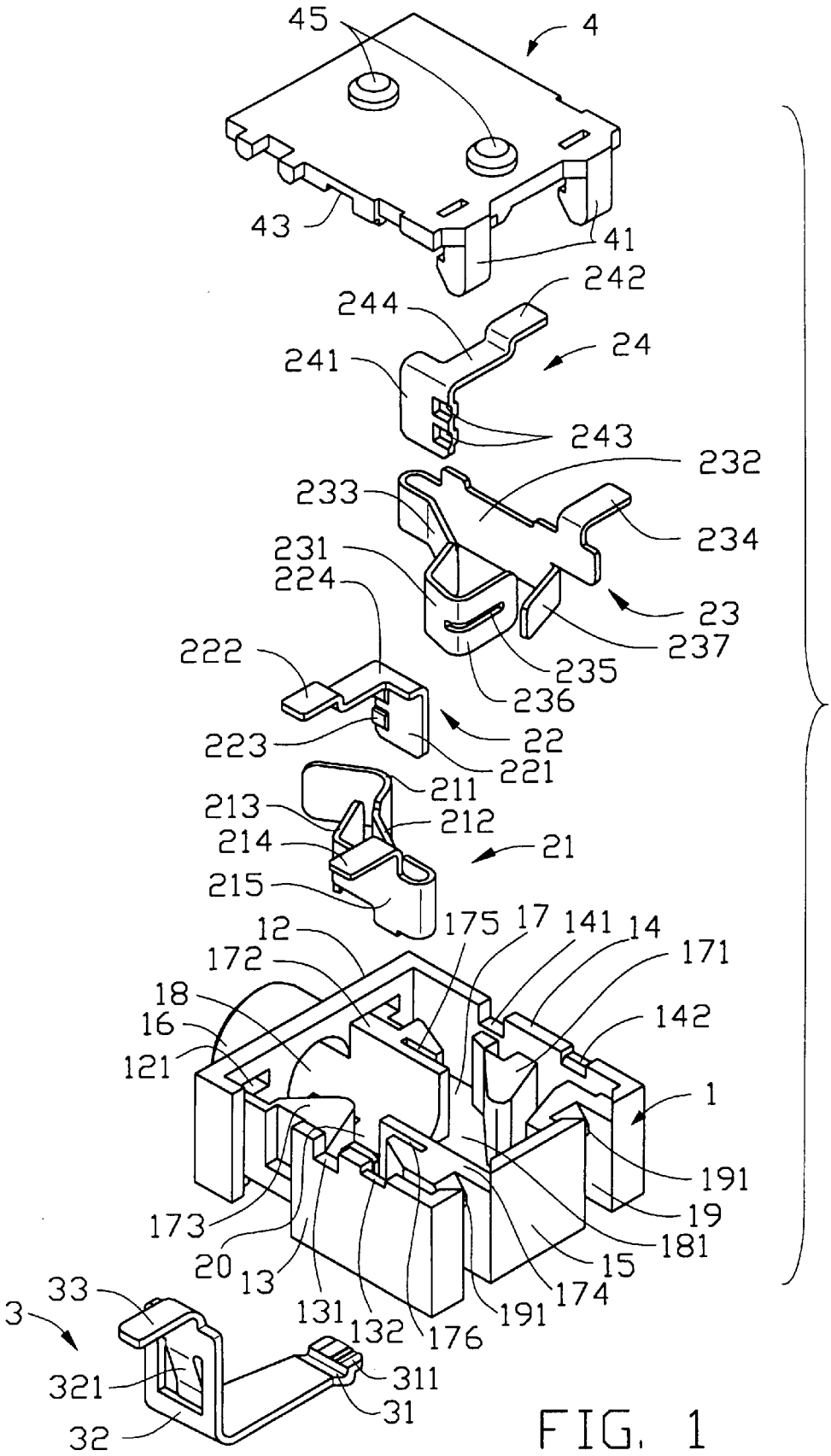
FIG. 1 is an exploded view of an electrical jack in accordance with the present invention.
Figure 2:
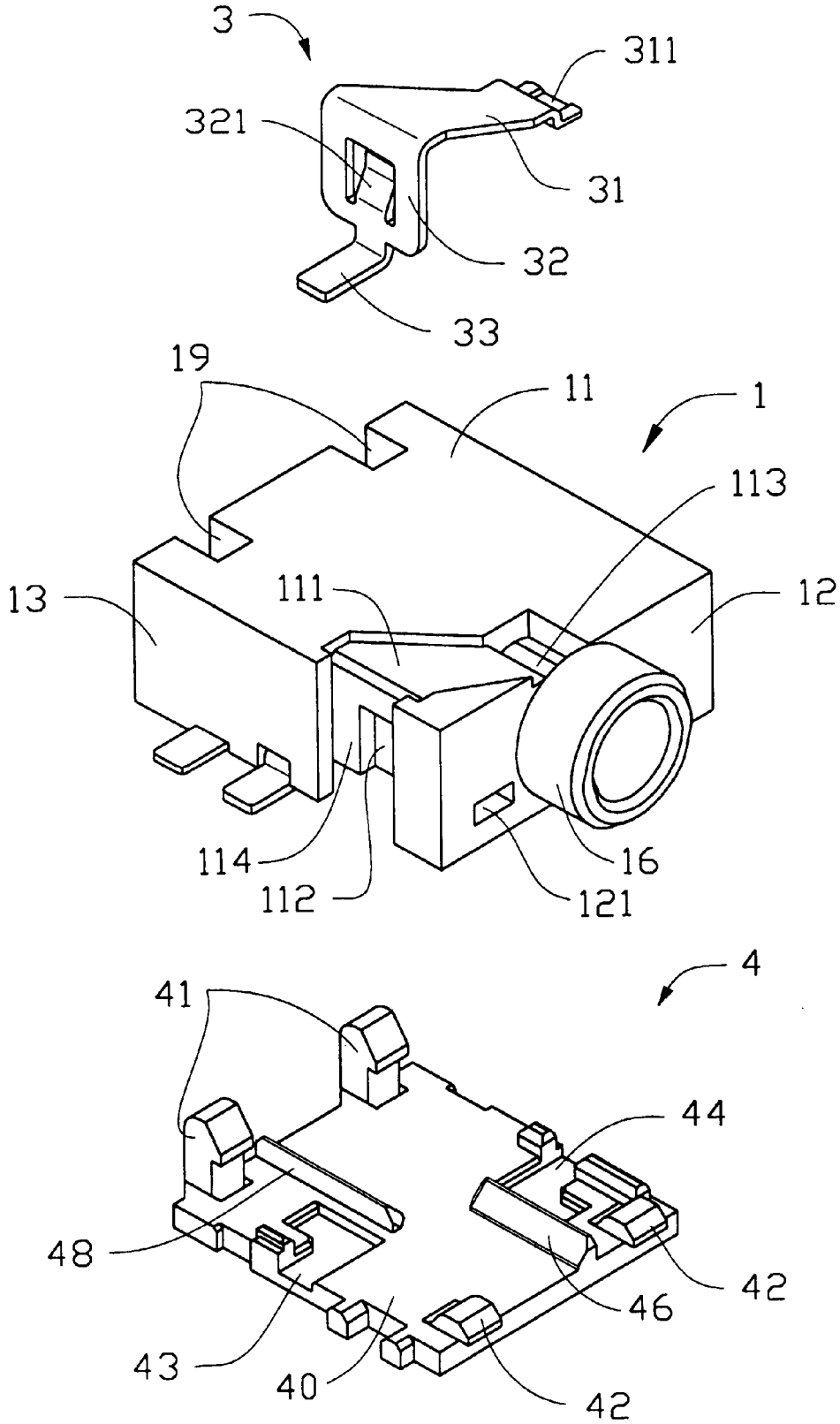
FIG. 2 is a partially assembled view of FIG. 1 before a grounding terminal and a bottom member are mounted to the electrical jack.

Referring to FIGS. 1 and 2, an electrical jack in accordance with the present invention comprises an insulative body 1 and an insulative bottom member 4. The body 1 includes a top wall 11, a front wall 12, a rear wall 15, a right wall 13 and a left wall 14. An interior space 181 is defined in the body 1 between the top wall 12, the front wall 12, the rear wall 15, the right wall 13 and the left wall 14. A first projection 171 and a first fixing portion 172 are arranged in the interior space 181 proximate the left wall 14 of the body 1. A second projection 173 and a second fixing portion 174 are arranged proximate the right wall 13 of the body 1 at positions corresponding to the first fixing portion 172 and the first projection 171. The first projection 171 and the first fixing portion 172 define a first passageway 17 and the second projection 173 and the second fixing portion 174 define a second passageway 20. The first fixing portion 172 and the second fixing portion 174 define a first securing recess 175 and a second securing recess 176, respectively. A first recess 131 and a second recess 132 are defined in a lower edge of the right wall 13. A first notch 141 and a second notch 142 are defined in a lower edge of the left wall 14. A pair of securing grooves 19 is defined in the rear wall 15 with a lock 191 projecting therein. A circular portion 16 forwardly extends from the front wall 12 with a tunnel 18 defined therethrough in communication with the interior space 181. A pair of apertures 121 is defined in the front wall 12 of the body 1.

A first signal terminal 23 includes a fixing portion 232 and a spring portion 233 reversely bent from one end of the fixing portion 232. A solder portion 234 is outwardly bent proximate opposite end of the fixing portion 232. An engaging portion 237 is inwardly bent from the fixing portion 232 proximate the solder portion 234. The spring portion 233 has an arcuate portion 231 and a contact portion 236 proximate the arcuate portion 231 and facing the engaging portion 237 thereof. The contact portion 236 of the first signal terminal 23 can engage the engaging portion 237 thereby providing a short electrical path therethrough. A slit 235 is formed in the arcuate portion 231 and the contact portion 236 for providing resiliency.

A second signal terminal 21 structurally similar to the first signal terminal 23 includes a fixing section 215 and a spring section 212 reversely bent from an end of the fixing section 215. An engaging section 213 is inwardly bent from an opposite end of the fixing section 215. A solder section 214 outwardly extends from an edge of the fixing section 215. The spring section 212 has an arcuate section 211 at a distal end thereof. The engaging section 213 of the second signal terminal 21 is adapted to engage the spring section 212 thereby providing a short electrical path therethrough.

Figure 3:
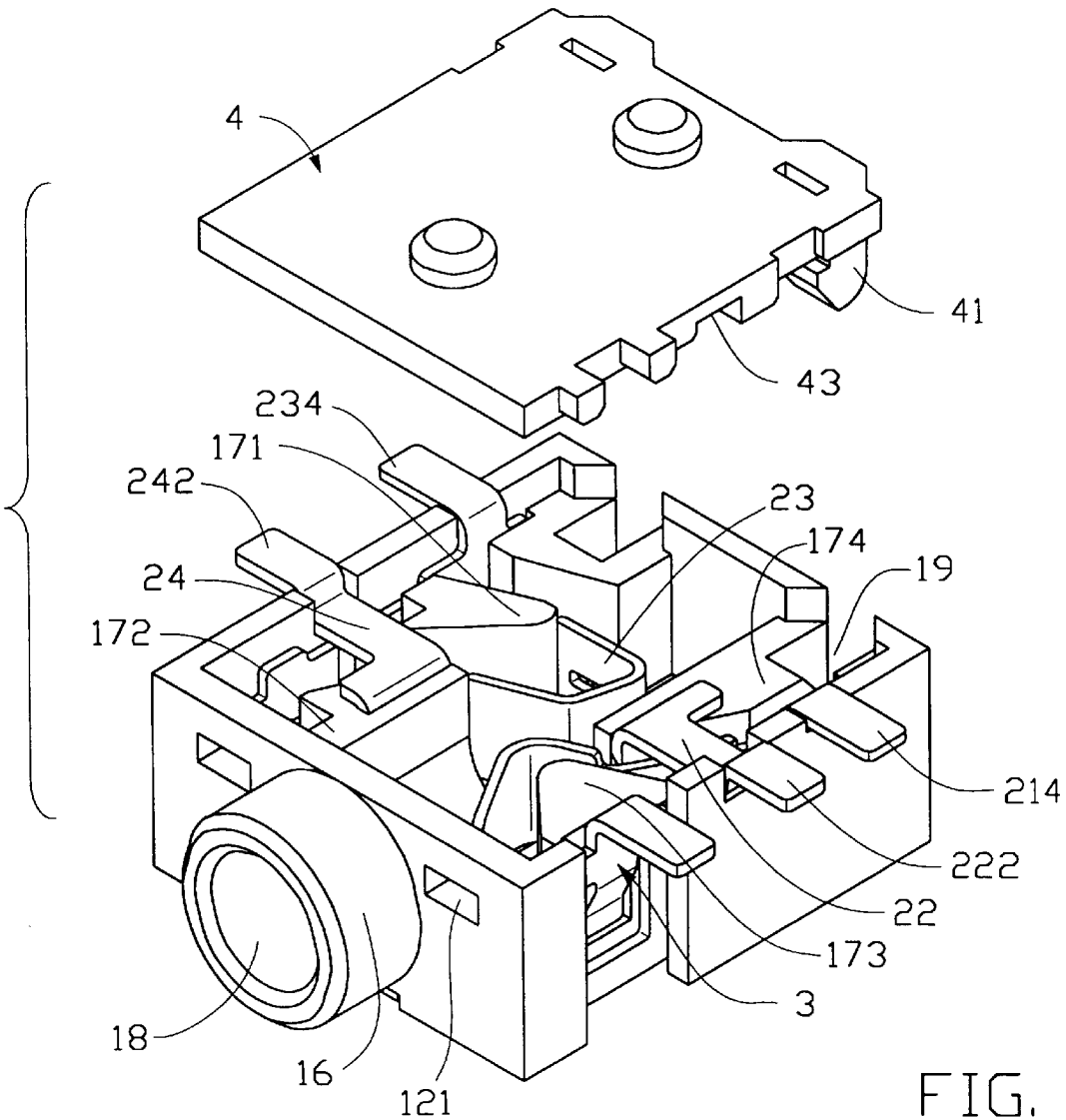
FIG. 3 is a partially assembled view of FIG. 1 before the bottom member is mounted to the electrical jack.

Also referring to FIG. 3, the first signal terminal 23 is secured in the first passageway 17 and fixed by the first projection 171 and the first fixing portion 172 with the solder portion 234 extending out of the body 1 through the second notch 142 for being soldered to a circuit board (not shown). The second signal terminal 21 is secured in the second passageway 20 and fixed by the second projection 173 and the second fixing portion 174 with the solder section 214 extending out of the body 1 through the second recess 132.

A first detecting terminal 24 includes a base portion 244 and a fitting portion 241 perpendicular to the base portion 244. The base portion 244 forms a stepped portion 242 at a free end thereof. The fitting portion 241 forms a pair of embossments 243 interferentially fitting in the first securing recess 175 of the first fixing portion 172. The stepped portion 242 of the first detecting terminal 24 extends out of the body 1 through the first notch 141 for being soldered to the circuit board. A second detecting terminal 22 includes a base section 224 and a fitting section 221 perpendicular to the base section 224. The base section 224 forms a stepped section 222 at a free end thereof extending out of the body 1 through the second recess 132. The fitting section 221 forms a pair of embossments 223 interferentially fitting in the second securing recess 176 of the second fixing portion 174. Since the first and second detecting terminals 24, 22 are not a feature of the present invention, a further detailed description of the function thereof is omitted herein.

The right wall 13 of the body 1 forms a first fixing groove 114 with a securing notch 112 defined therein. The top wall 11 defines a second fixing groove 111. An opening 113 is defined in the top wall 11 in communication with the interior space 181. A grounding terminal 3 has a center portion 32 with a lance 321 inwardly stamped therein, an elongate portion 31 inwardly extending from an upper edge of the center portion 32, and a solder pad 33 outwardly extending from a lower edge of the center portion 32. A stepped engaging portion 311 ends from the elongate portion 31. The grounding terminal 3 is adapted to be mounted to the body 1 with the center portion 32 received in the first fixing groove 114 and the elongate portion 31 received in the second fixing groove 111. The engaging portion 311 of the grounding terminal 3 extends into the opening 113 of the top wall 11 of the body 1 for contacting a corresponding portion of an inserted connector (not shown). The lance 321 of the grounding terminal 3 is received in the securing notch 112 of the first fixing groove 114 for retaining the grounding terminal 3. The solder pad 33 extends beyond the body 1 for being soldered to the circuit board.

The bottom member 4 is adapted to be mounted to the lower portion of the body 1 thereby securing the signal terminals 23, 21 and detecting terminals 24, 22 therein. The bottom member 4 includes a pair of standing hooks 41 upwardly projecting from a top surface 40 thereof proximate a rear edge for extending into the securing grooves 19 of the rear wall 15 of the body 1 and engaging with the locks 191. A first elongate rib 46 and a second elongate rib 48 are arranged on the top surface 40 of the bottom member 4 for pressing against the first and second detecting terminals 24, 22, respectively. A first L-shaped recess 44 and a second L-shaped recess 43 are defined in the top surface 40 of the bottom member 4 proximate a right side and a left side thereof for engaging the first detecting terminal 24 and the second detecting terminal 22, respectively. A pair of latches 42 is formed proximate the front edge of the bottom member 4 for engaging with the aperture 121 of the front wall 12 thereby securing the bottom member 4 to the body 1. A pair of guiding posts 45 projects from a bottom surface of the bottom member 4 for insertion into corresponding holes of the circuit board.

Figure 4:
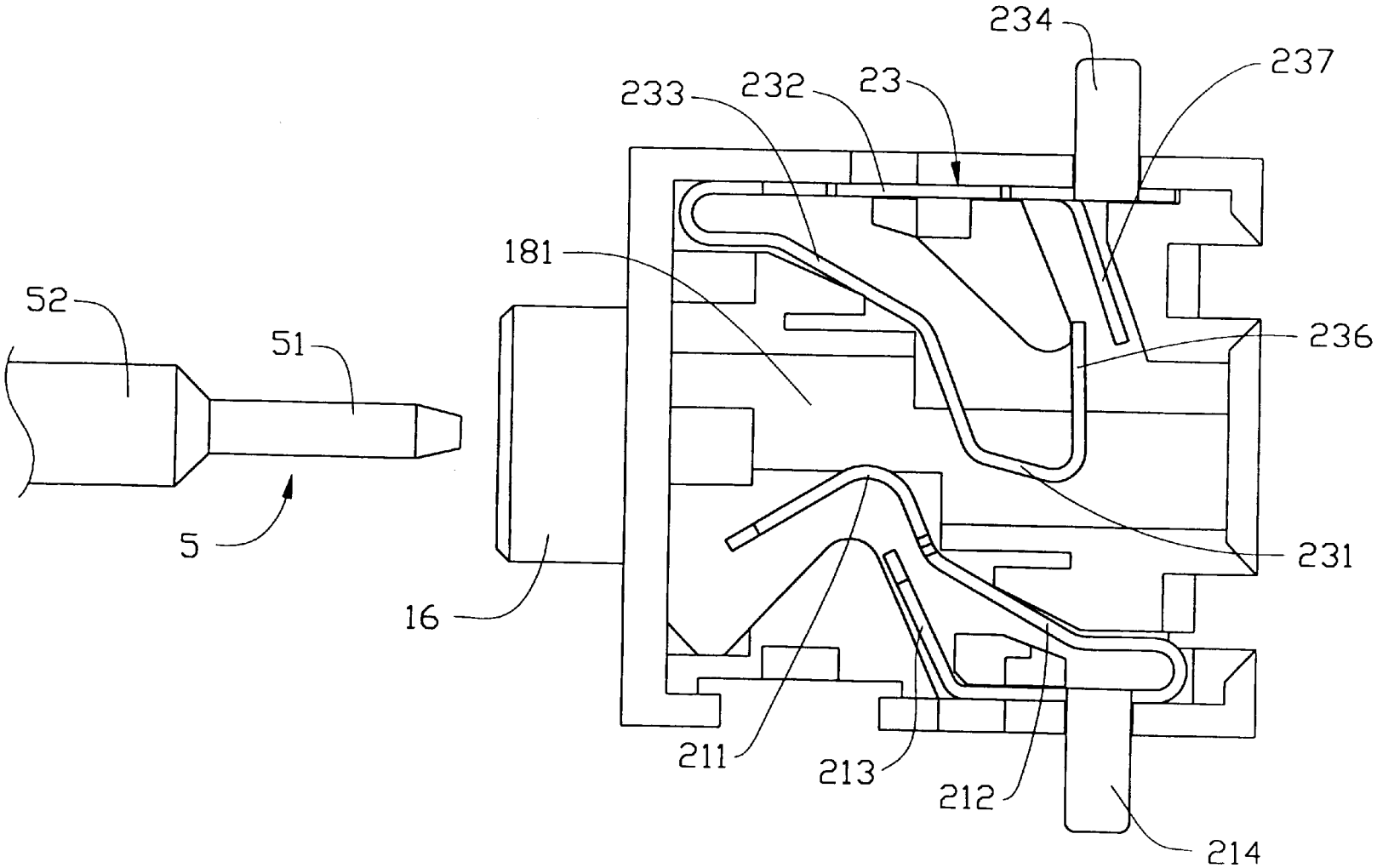
FIG. 4 is a bottom view of the electrical jack with the bottom member, the detecting terminals removed therefrom, before a pin of a connector is inserted therein.

Referring to FIGS. 3 and 4, before the mating contact of the inserted connector is inserted into the tunnel 18, the first signal terminal 23 contacts the first detecting terminal 24 and the second signal terminal 21 contacts the second detecting terminal 22, so that it is recognized that the jack is in an un-mated manner.

Figure 5:
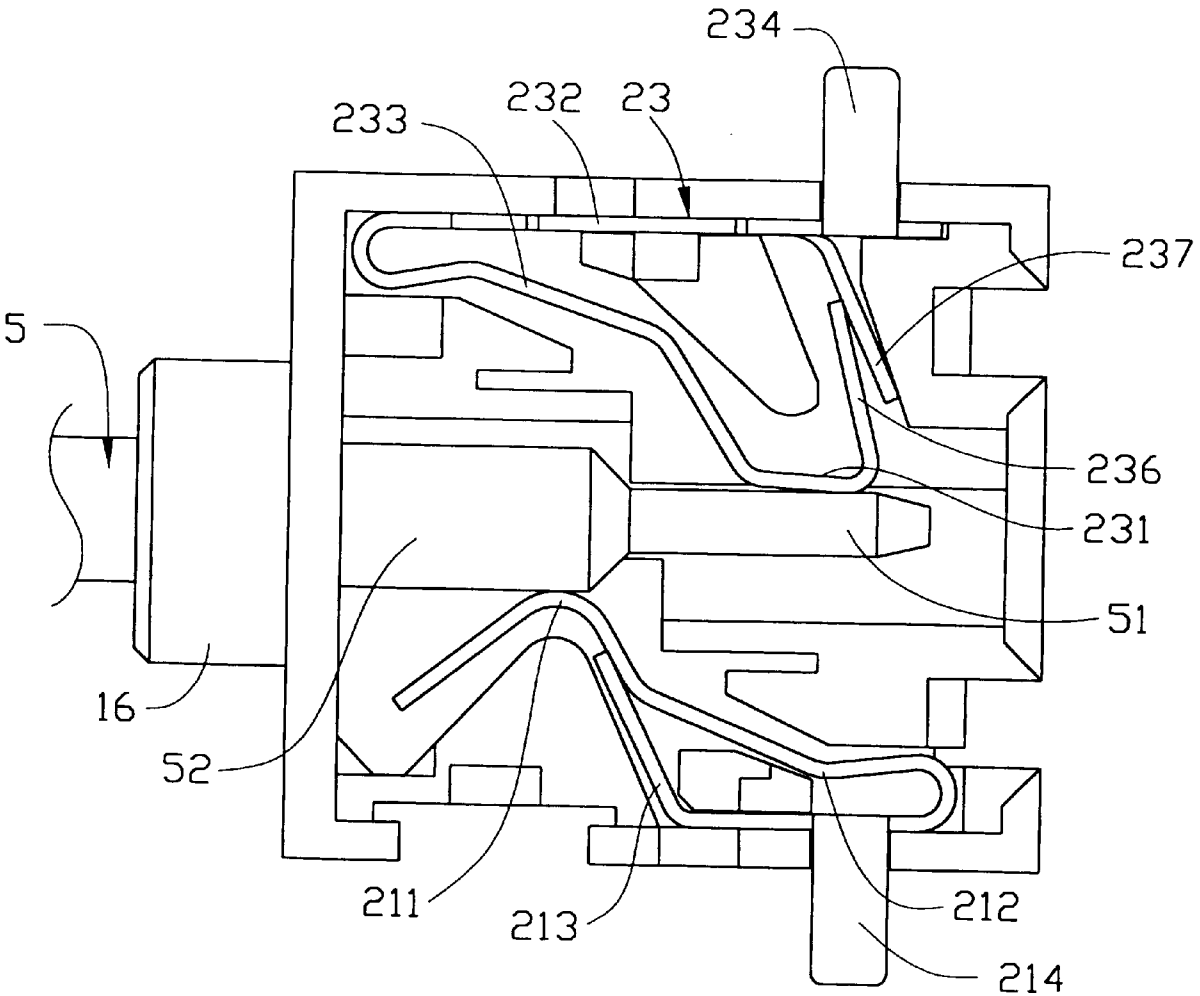
FIG. 5 is similar to FIG. 4, after a pin of a connector is inserted therein.

Referring to FIGS. 4 and 5, a mating contact 5 of the inserted connector includes a narrow section 51 and a wide section 52. When the mating contact 5 is inserted into the interior space 181 of the body 1 through the tunnel 18 of the circular portion 16, the narrow section 51 of the mating contact 5 engages the arcuate portion 231 of the first signal terminal 23 thereby deflecting the contact portion 236 of the first signal terminal 23 to contact the engaging portion 237 thereof for providing a short electrical path therethrough. Simultaneously, the spring portion 233 is disengaged from the first detecting terminal 24. Similarly, the wide portion 52 of the mating contact 5 engages the arcuate section 211 of the second signal terminal 21 thereby deflecting the arcuate section 211 to contact the engaging section 213 thereof for providing a short electrical path therethrough, and simultaneously, the spring section 212 is disengaged from the second detecting terminal 22. As a result, it is recognized that the jack is in a mating manner. Understandably, such short electrical paths provide an excellent conductivity for signal transmission therethrough.

While the present invention has been described with reference to a specific embodiment, the description is illustrative of the invention and is not to be construed as limiting the invention. Various modifications to the present invention can be made to the preferred embodiment by those skilled in the art without departing from the true spirit and scope of the invention as defined by the appended claims.

What is claimed is:

1. An electrical jack for mating with an engaging connector, comprising:

an insulative housing including an insulative body and an insulative bottom member, the body defining an interior space therein, a tunnel being formed in a front wall of the body and being in communication with the interior space, a securing groove being defined in a rear wall of the body, a standing hook upwardly extending from the bottom member and engaging with the securing groove of the body thereby securing the body and the bottom member together; and a signal terminal being mounted in the interior space, the signal terminal including a fixing portion and a movable portion bent from the fixing portion, the movable portion being deflectable upon insertion of an engaging connector through the tunnel to contact the fixing portion to establish a short electrical path therethrough.

2. The electrical jack as claimed in claim 1, wherein a projection is arranged in the interior space and defines a passageway for securing the signal terminal.

3. The electrical jack as claimed in claim 1, wherein the movable portion of the signal terminal has an arcuate portion with a slit defined therein.

4. The electrical jack as claimed in claim 1, wherein a aperture is defined in a front wall of the body, and wherein a latch is formed proximate a front edge of the bottom member for engaging with the aperture thereby securing the bottom member to the body.

5. The electrical jack as claimed in claim 1, wherein a lock projects into the securing groove of the body for engaging with the standing hook of the bottom member thereby securing the bottom member to the body.

6. The electrical jack as claimed in claim 1, wherein a detecting terminal is mounted in the interior space, and a fixing portion is arranged in the interior space and defines a securing recess for securing the detecting terminal.

7. The electrical jack as claimed in claim 6, wherein an elongate rib is arranged on a top surface of the bottom member for pressing against the detecting terminal.

8. The electrical jack as claimed in claim 1, wherein a grounding terminal is attached to one side wall and a top wall of the body with one portion thereof projecting into the interior space.

9. The electrical jack as claimed in claim 6, wherein the body defines a fixing groove in a side wall thereof with a securing notch defined therein, and wherein the grounding terminal has a center portion with a lance inwardly stamped therein, the center portion being received in the fixing groove, the lance being adapted to engage with the securing notch thereby securing the grounding terminal to the body.

10. An electrical jack for mating with an engaging connector, comprising:

an insulative housing defining an interior space therein, a tunnel being in communication with the interior space; and a signal terminals and a corresponding detecting terminal being mounted in the interior space, the signal terminal including a fixing portion and a movable portion bent from the fixing portion; wherein the movable portion is engaged with the detecting terminal when the jack in a un-mated manner, while is deflectable, upon insertion of an engaging connector through the tunnel, to be disengaged from the detecting terminal but contact the fixing portion to establish a short electrical path therethrough when the jack in a mated manner.

* * * * *